US009816368B2

(12) United States Patent
Trichel et al.

(10) Patent No.: US 9,816,368 B2
(45) Date of Patent: Nov. 14, 2017

(54) ACTIVE CONTROL OF DRILL BIT WALKING

(71) Applicants: Donald Keith Trichel, Houston, TX (US); Andreas Peter, Celle (DE); Oliver Hoehn, Celle (DE); Steffen Schulze, Celle (DE)

(72) Inventors: Donald Keith Trichel, Houston, TX (US); Andreas Peter, Celle (DE); Oliver Hoehn, Celle (DE); Steffen Schulze, Celle (DE)

(73) Assignee: Baker Hughes, a GE company, LLC, Houston, TX (US)

( * ) Notice: Subject to any disclaimer, the term of this patent is extended or adjusted under 35 U.S.C. 154(b) by 871 days.

(21) Appl. No.: 13/894,117

(22) Filed: May 14, 2013

(65) Prior Publication Data

US 2014/0338974 A1 Nov. 20, 2014

(51) Int. Cl.

| | |
|---|---|
| ***E21B 44/00*** | (2006.01) |
| ***E21B 47/024*** | (2006.01) |
| ***E21B 7/06*** | (2006.01) |

(52) U.S. Cl.

CPC ..... *E21B 44/00* (2013.01); *E21B 7/062* (2013.01); *E21B 47/024* (2013.01)

(58) Field of Classification Search

CPC ..... E21B 44/00; E21B 44/02; E21B 7/062; E21B 7/10; E21B 7/06; E21B 47/024

See application file for complete search history.

(56) References Cited

U.S. PATENT DOCUMENTS

| | | | | |
|---|---|---|---|---|
| 5,220,963 | A * | 6/1993 | Patton | E21B 7/04 175/24 |
| 5,608,162 | A | 3/1997 | Ho | |
| 2005/0150692 | A1 | 7/2005 | Ballantyne et al. | |
| 2007/0192074 | A1 | 8/2007 | Chen | |
| 2007/0240904 | A1 | 10/2007 | Stauffer et al. | |
| 2008/0135292 | A1 | 6/2008 | Sihler et al. | |

OTHER PUBLICATIONS

Notification of Transmittal of the International Search Report and the Written Opinion of the International Searching Authority; PCT/US2014/037697; dated Oct. 10, 2014; 10 pages.

Menand et al., "How the Bit Profile and Gages Affect the Well Trajectory", IADC/SPE 74459, IADC/SPE Drilling Conference, Dallas, TX, Feb. 26-28, 2002, pp. 1-13.

* cited by examiner

*Primary Examiner* — Wei Wang

(74) *Attorney, Agent, or Firm* — Cantor Colburn LLP

(57) ABSTRACT

An apparatus for drilling a borehole into an earth formation includes: a drill bit configured to be rotated to drill into the formation; a drill tubular coupled to the drill bit and configured to rotate the drill bit; a steering device coupled to the drill string and configured to impart a force on the drill string to control a direction of drilling; and a controller configured to communicate a control signal to the steering device. The control signal includes information for directing actuation of the steering device for steering the drill bit in an intended drilling direction. The controller is further configured to direct the steering device to provide a compensating force on the drill string that prevents or reduces an azimuthal deviation from the intended drilling direction due to drill bit walking.

17 Claims, 5 Drawing Sheets

ACTIVE CONTROL OF DRILL BIT WALKING

BACKGROUND

Boreholes are drilled into the earth for various purposes such as hydrocarbon exploration and production, geothermal production, and carbon dioxide sequestration. A borehole is typically drilled by rotating a drill bit for cutting into formation rock, which is then evacuated from the borehole. Unfortunately, the interaction of the drill bit with the rock can cause the drill bit to move or walk away from an intended drilling direction. It would be well received in the drilling and geophysical exploration industries if apparatus and method could be developed to prevent drill bit walking.

BRIEF SUMMARY

Disclosed is an apparatus for drilling a borehole into an earth formation. The apparatus includes: a drill bit configured to be rotated to drill into the formation; a drill tubular coupled to the drill bit and configured to rotate the drill bit; a steering device coupled to the drill string and configured to impart a force on the drill string to control a direction of drilling; and a controller configured to communicate a control signal to the steering device, the control signal comprising information for directing actuation of the steering device for steering the drill bit in an intended drilling direction; wherein the controller is further configured to direct the steering device to provide a compensating force on the drill string that prevents or reduces an azimuthal deviation from the intended drilling direction due to drill bit walking.

Also disclosed is a method for drilling a borehole into an earth formation. The method includes: drilling into the formation with a drill bit being rotated by a drill tubular; and communicating a control signal from a controller to a steering device coupled to the drill tubular, the control signal includes information for directing actuation of the steering device for imparting a force on the drill string to control an intended direction of drilling; wherein the control signal includes instructions for the steering device to impart a compensating force on the drill tubular that prevents or reduces an azimuthal deviation from the intended drilling direction due to drill bit walking.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are apparatus and method for drilling a borehole into an earth formation using a drill string that rotates a drill bit. The apparatus and method call for automatically applying a compensating force to the drill string that compensates for a bit walking force that forces the drill bit to drill or walk away from an intended drilling azimuth.

Figure 1:
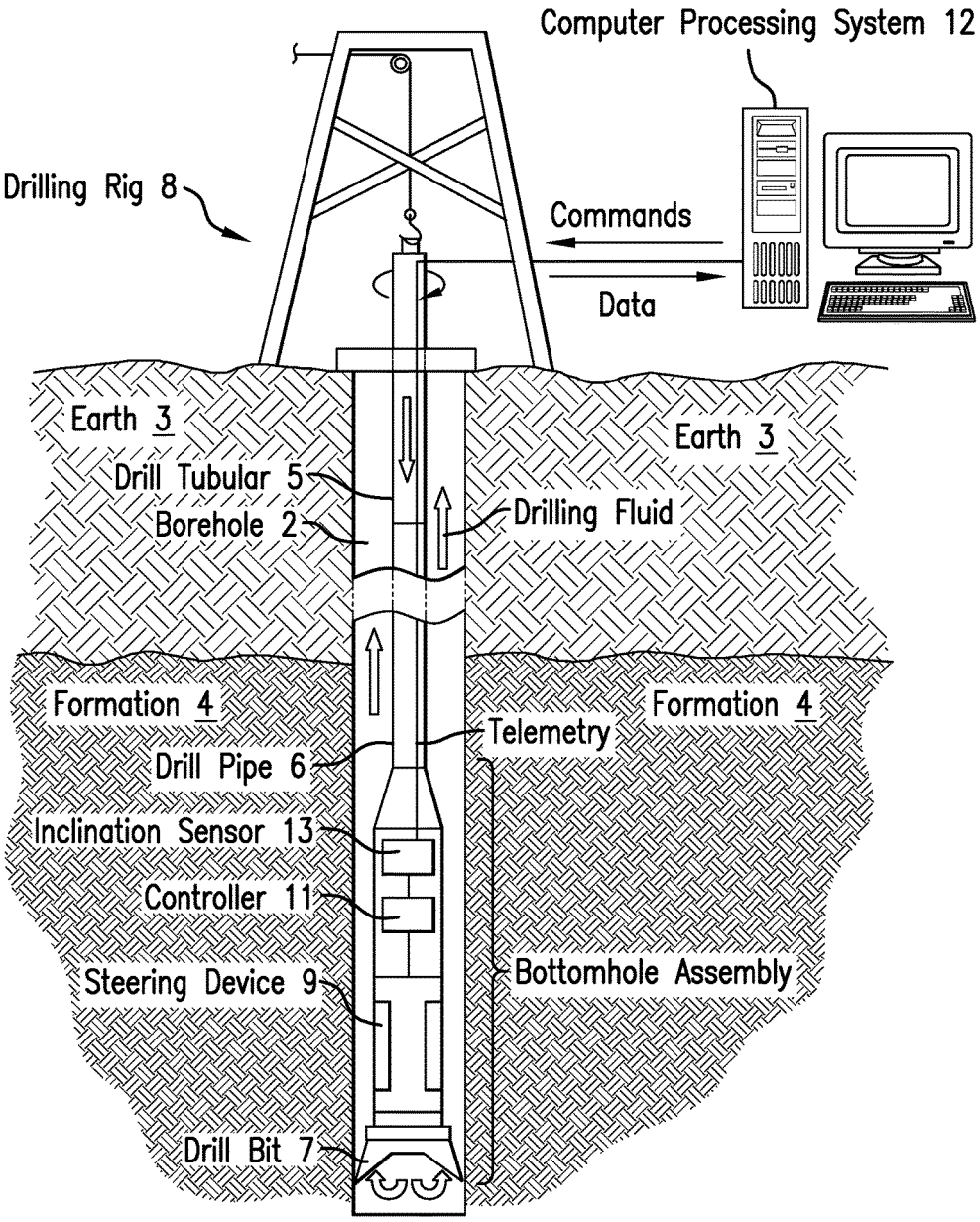
FIG. 1 illustrates a cross-sectional view of an exemplary embodiment of a drill string having a drill bit disposed in a borehole penetrating the earth.

FIG. 1 illustrates a cross-sectional view of an exemplary embodiment of a drill tubular 5 disposed in a borehole 2 penetrating the earth 3, which may include an earth formation 4. The formation 4 represents any subsurface material of interest that may bed drilled by the drill tubular 5. In the embodiment of FIG. 1, the drill tubular 5 is a drill string made of drill pipes 6 serially coupled together. A drill bit 7 is disposed at the distal end of the drill tubular 5. A drill rig 8 is configured to conduct drilling operations such as rotating the drill tubular 5 and thus the drill bit 7 in order to drill the borehole 2. In addition, the drill rig 8 is configured to pump drilling fluid through the drill string 6 in order to lubricate the drill bit 7 and flush cuttings from the borehole 2. A steering device 9 is coupled to the drill tubular 5 and is configured to steer the drilling of the borehole 2 in a desired or intended direction. The intended direction may include an inclination direction (i.e., up or down with respect to the earth's surface) and/or an azimuthal direction (i.e., with respect a reference azimuth such as true or grid north). It can be appreciated that in one or more embodiments the steering device 9 is disposed close to the drill bit 7, within three feet for example, so that the force or portion of the force being applied to the drill tubular 5 by the steering device 9 is also being applied to the drill bit 7. The steering device 9 in one or more embodiments may be considered as part of the drill tubular 5. A controller 11 is configured to control the steering device 9 to steer the drilling of the borehole in the desired direction. The controller 11 may also act as an interface with telemetry to communicate data or commands between downhole components and a computer processing system 12 disposed at the surface of the earth 3. Non-limiting embodiments of the telemetry include pulsed-mud and wired drill pipe. System operation, control and/or data processing operations may be performed by the controller 11, the computer processing system 12, or a combination thereof.

In one or more embodiments, an inclination sensor 13 is disposed at the drill tubular 5 and coupled to the controller 11. The inclination sensor 13 is configured to sense inclination of the drill tubular 5 where the sensor 13 is disposed. In one or more embodiments, the inclination sensor 13 is configured to sense inclination using the direction of gravity as a reference. The term "inclination" relates to a vertical direction or angle such that the direction at zero degrees is horizontal, a positive direction or angle points to the surface of the earth 3, or a negative direction or angle points deeper into the earth 3. In contrast, the term "azimuthal" relates to a direction or angle with respect to a reference direction such as true north or grid north. In one or more embodiments, the controller 11 is configured to provide feedback control of drilling inclination using input from the inclination sensor 12 to control the steering device 9. The controller 11 may contain various control algorithms such as proportional (P) control, integral (I) control, proportional-integral-differential (PID) control, or some combination thereof. In one or more embodiments, an inclination setpoint for inclination feedback control may be transmitted to the controller 11 from the surface of the earth 3 by a surface interface such as the computer processing system 12. In one or more embodiments, a user such as a drill operator may manually input the inclination set point into the surface interface which then transmits the setpoint downhole to the controller 11.

Figure 2:
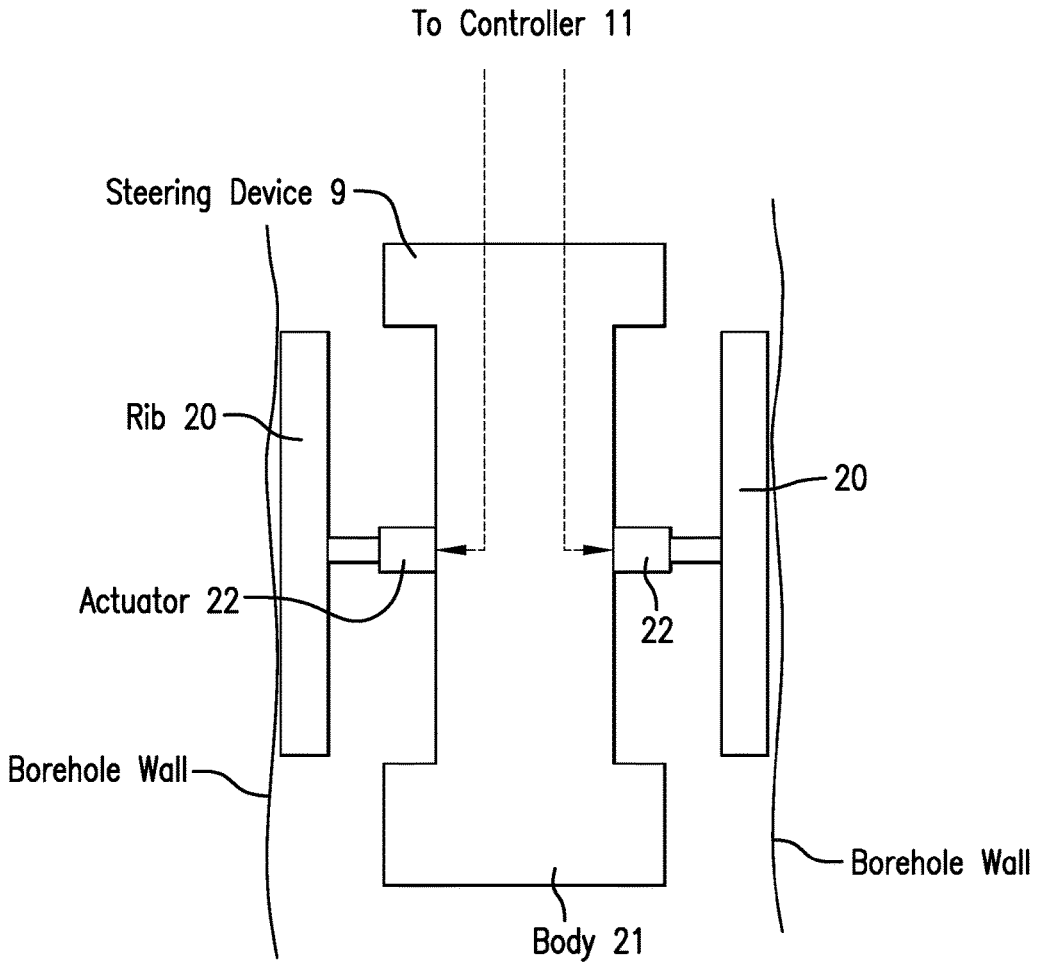
FIG. 2 depicts aspects of a steering device configured to control the drilling direction of the drill bit.

Reference may now be had to FIG. 2 depicting aspects of one embodiment of the steering device 9 in a cross-sectional view. The steering device 9 includes a plurality of ribs 20 configured to extend from a body 21. The drill tubular 5 is free to rotate within the body 21. Each rib 20 is coupled to an actuator 22 configured to extend in order to extend the corresponding rib. The actuator 22 applies a force to the corresponding rib 20 causing that rib 20 to extend until it contacts the borehole wall. With the rib 20 in contact with the borehole wall, a force is applied to the drill tubular 5 by the actuator 22 that is equal and opposite to the force applied to the rib 20. In general, the plurality of ribs 20 is disposed symmetrically (although they do not have to be) about the body 21 such that a combination of all forces applied to the drill tubular 5 by all the actuators 22 is a resultant force vector having a magnitude and direction that urges the drill tubular 5 and the drill bit 7 to drill the borehole 2 in an intended direction. The controller 11 is coupled to each actuator 22 for controlling extension of the ribs 20 and therefore controlling the force being applied to the drill tubular 5. By knowing the maximum force that each actuator 22 is capable of applying, the controller 11 can direct each actuator 22 to apply a certain percentage of the maximum force (e.g., 0-100% of maximum) in order to achieve a desired combined vector force applied to the drill tubular 5.

In one or more embodiments, the actuators 22 may be powered hydraulically by a hydraulic pump (not shown) with the controller 11 controlling the hydraulic pressure and, thus, the force being applied to each rib 21 with the combined vector force being applied to the drill tubular 5. In one or more embodiments, the controller 11 controls the hydraulic pressure by controlling the pump speed and/or position of a pump discharge valve (not shown).

Figure 3:
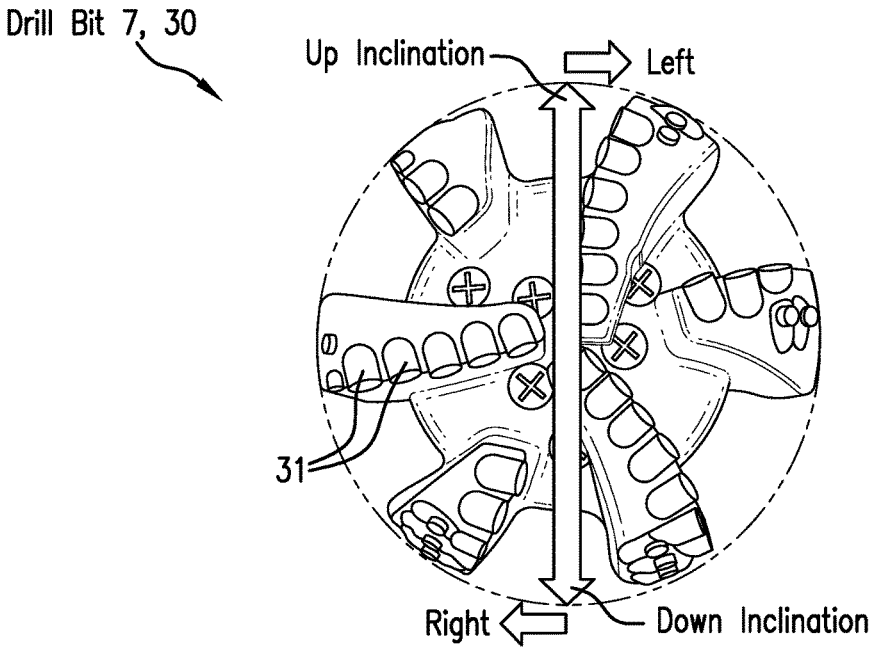
FIG. 3 depicts aspects of a drill bit having fixed cutters.

Reference may now be had to FIG. 3 depicting aspects of a drill bit 30 having fixed cutters 31 in a bottom view. In one or more embodiments, the fixed cutters 31 are made of polycrystalline diamond (PCD). Directions are generally provided with reference to a top view, so the directions of motion when viewed from a bottom view are reversed. It can be appreciated that when the drill tubular rotates clockwise (in a top view) a force (i.e., side load) applied to the drill bit 30 to increase the inclination (i.e. in up direction) will cause the drill bit 30 to walk or move to the left due to the increased force on the drill bit 30 in the up direction. Walking to the left may be described as having a negative azimuthal angle. Similarly, a force applied to the drill bit to decrease inclination (i.e., in down direction) will cause the drill bit 30 to walk to the right. Walking to the right may be described as having a positive azimuthal angle. In one or more embodiments, the walking force is perpendicular to the inclination force so that the drilling direction is determined by the vector combination of the inclination force and the walking force applied to the drill bit with the walking force being a function of the inclination force.

Figure 4:
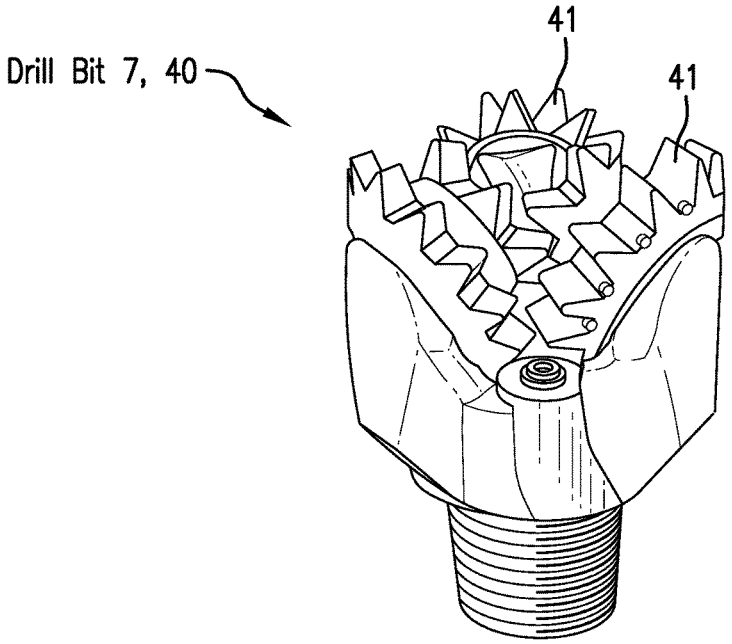
FIG. 4 depicts aspects of a drill bit having rolling cutters.

Reference may now be had to FIG. 4 depicting aspects of a drill bit 40 having roller cutters 41 that are configured to rotate as they cut into formation rock. It can be appreciated that due to the roller action of the drill bit 40 the walking forces applied to the drill bit 40 will be opposite of the walking forces applied to the drill bit 30 due to the application of the same forces used to change the inclination of the drill bit. That is, an inclination force or side load that causes the drill bit 40 to increase inclination will cause the drill bit 40 to walk to the right. An inclination force to cause the drill bit 40 to decrease inclination will cause the drill bit 40 to walk to the left.

Figure 5A:
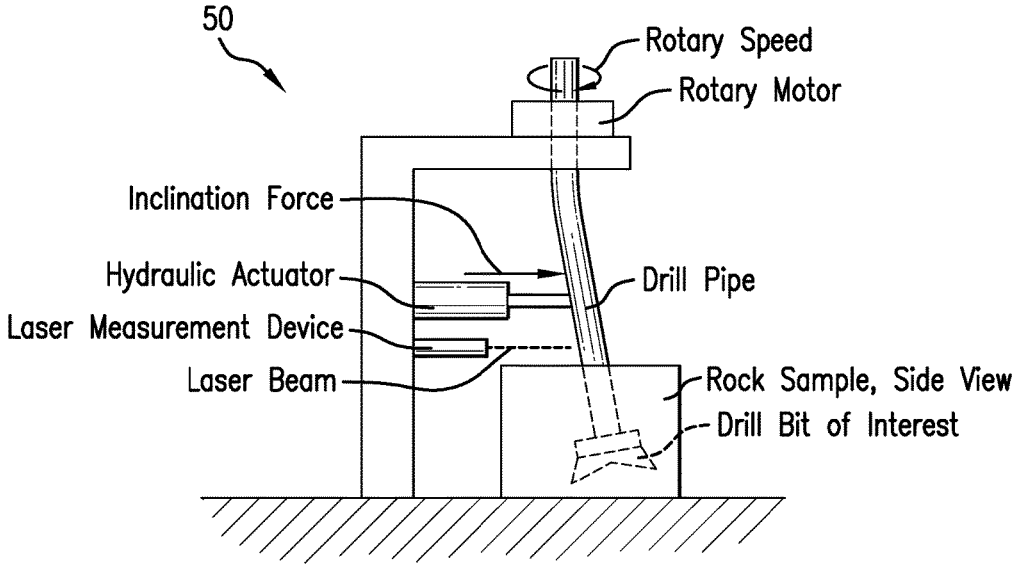
FIGS. 5A and 5B, collectively referred to as FIG. 5, depict aspects of testing a drill bit for a bit walk force.
Figure 5B:
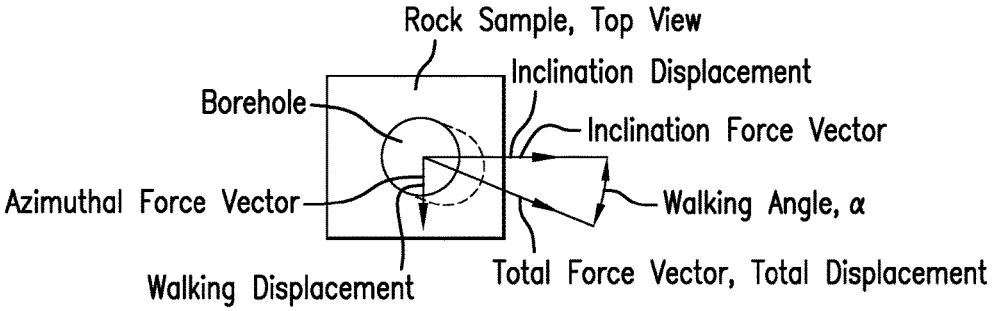

Reference may now be had to FIG. 5 depicting aspects of testing a drill bit of interest to determine a drill bit walking force (i.e., azimuthal force) resulting from an applied inclination force. In the embodiment illustrated in FIG. 5A, a test stand 50 is configured to rotate the drill bit of interest in a rock sample. From the inclination displacement of the drill bit resulting from a known inclination force, the walking angle $\alpha$ can be measured, generally using a laser measurement device, strain gauges (not shown), or other precision measurement devices. From the walking angle, the walking force that would cause the drill bit 7 to walk at that angle can be calculated. Hence, for the specific drill bit 7 being tested, the walking force is correlated to a percentage value of the inclination force. By knowing the percentage value for a specific type of drill bit, the controller 11 can direct the steering device 9 to apply an opposing force equal to the percentage value multiplied times the known inclination force to prevent that specific type of drill bit from walking when the inclination force is being applied. For example, if one specific type of drill bit has a tendency to walk left and a percentage value of 20% and an inclination force (i.e., side load) of 2500 pound-force is being applied to that specific type of drill bit to change the drilling inclination, then the controller 11 can direct the steering device 9 to apply a compensating or counter force of 500 pound-force to the drill tubular and, thus, to the drill bit to prevent the drill bit from walking from an intended drilling direction. Without the compensating force, the walking angle would be about 11.3°. It can be appreciated that the determined percentage value may be dependent on the rotary speed being used to drill the borehole and, thus, percentage values may be determined for a plurality of rotary speeds of interest.

In one or more embodiments, the walking force is perpendicular to or has a vector component perpendicular to the inclination force vector. Accordingly, the compensating force is generally applied perpendicular to the inclination force vector and in a direction opposite of the walking force. Any walking force vector component aligned with the inclination force vector can be compensated for by the controller 11 using feedback from the inclination sensor 13.

It can be appreciated that for each specific type of drill bit that may be used several different magnitudes of inclination forces may be applied to that drill bit and corresponding walking forces or walking angles measured. The test data can be organized in a lookup table or a mathematical curve can be fit to the data enabling the controller 11 to determine and apply the appropriate compensating force when a known inclination force is or is going to be applied to the drill tubular 5 or drill bit 7.

Figure 6:
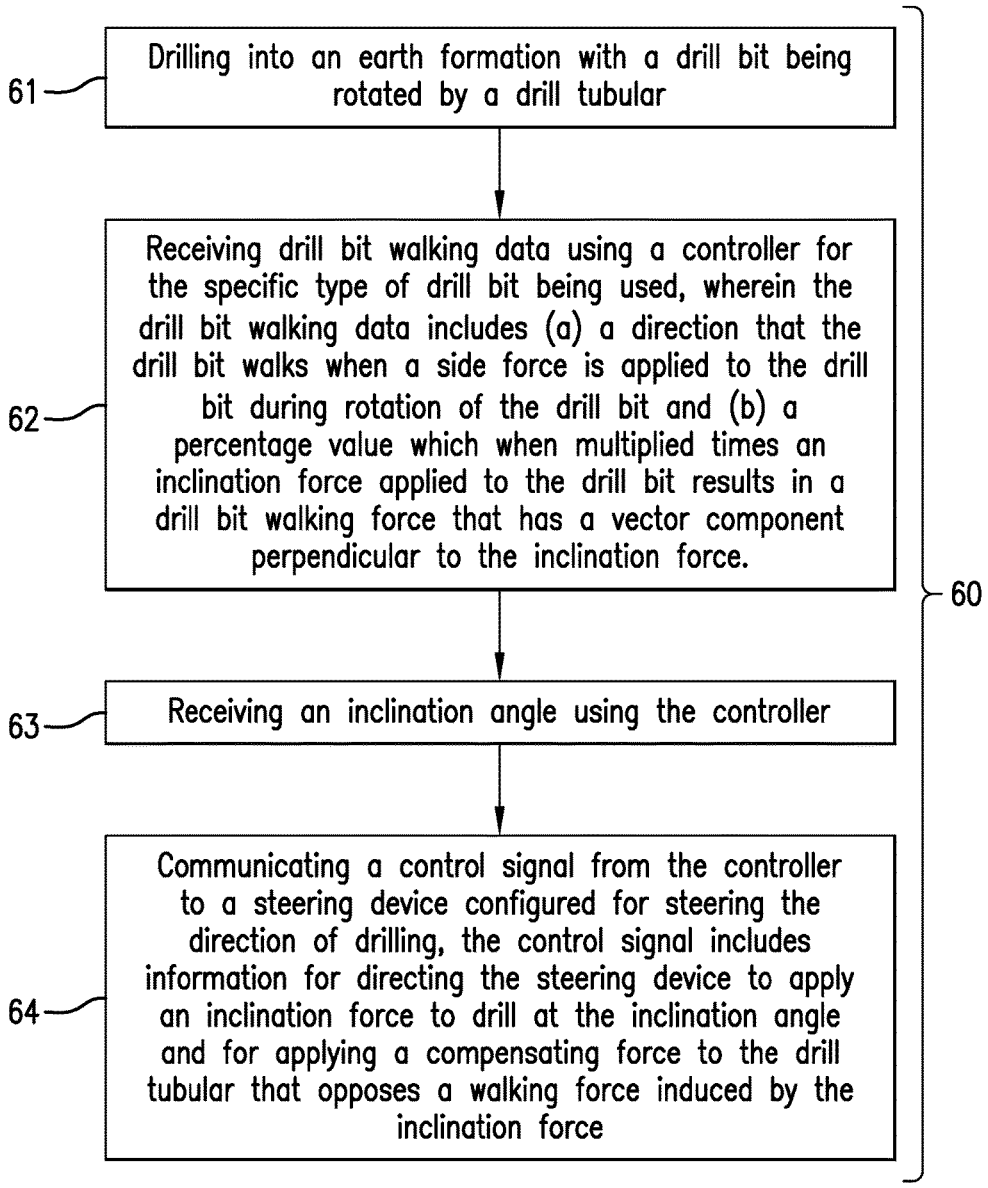
FIG. 6 is a flow chart of a method for drilling a borehole into an earth formation.

FIG. 6 is a flow chart for a method 60 for drilling a borehole into an earth formation. Block 61 calls for drilling into the formation with a drill bit being rotated by a drill tubular. Block 62 calls receiving drill bit walking data using a controller for the specific type of drill bit being used. The drill bit walking data includes (a) a direction that the drill bit walks when a side force is applied to the drill bit during rotation of the drill bit and (b) a percentage value which when multiplied times an inclination force applied to the drill bit results in a drill bit walking force that has a vector component perpendicular to the inclination force. Block 63 calls for receiving an inclination angle using the controller. Block 64 calls for communicating a control signal from the controller to a steering device configured for steering the direction of drilling. The control signal includes information for directing the steering device to apply an inclination force to drill at the inclination angle and for applying a compensating force to the drill tubular that opposes a walking force induced by the inclination force.

The above techniques provide several advantages. One advantage is that the borehole can be drilled in an intended azimuthal direction by automatically compensating for drill bit walking. The automatic aspects do not require operator intervention and, thus, the compensating force can be applied continuously or at a high rate as needed such as when an inclination force is being applied. This can result in a more accurately drilled borehole than if an operator had to take manual action to correct for drill bit walking after the time it takes to detect the drill bit walking.

It can be appreciated that the drill bit 7 can be a hybrid drill bit having both fixed cutters 31 and roller cutters 41. The test stand 50 can be used to determine the directional tendency of the hybrid drill bit and the associated percentage value of the inclination force that the hybrid bit walking force is.

It can be appreciated that on certain occasions the maximum force capability of the steering device 9 may be exceeded such as when the user calls for applying the maximum capable force in the inclination direction. On these occasions, the controller 11 will reduce the force being applied in the inclination direction and apply the appropriate walk compensation force so that drilling in the intended azimuthal direction can be maintained. In one or more embodiments in these situations, the maximum force capability will be applied in the direction of the vector sum of the inclination force and the walk compensation force (i.e., azimuth force in FIG. 5).

In one or more embodiments, a user may transmit to the controller 11, via the processing system 12, a new percentage of the inclination force that is to be applied as the walk compensation force. A borehole survey tool (not shown) may be disposed at the drill tubular 7 generally several feet away from the drill bit and steering device. If the survey tool, which can measure the azimuth of the already drilled borehole, detects drill bit walking that is not being compensated for (such as due to drill bit wear), the user can adjust the percentage value to correct the walking.

In support of the teachings herein, various analysis components may be used, including a digital and/or an analog system. For example, the controller 11, the computer processing system 12, or the inclination sensor 13 may include digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for drilling a borehole into an earth formation, the system comprising:

a drill bit configured to be rotated to drill into the formation;

a drill tubular coupled to the drill bit and configured to rotate the drill bit;

a steering device coupled to the drill tubular and configured to impart a force on the drill tubular to control a direction of drilling, the force comprising a first force in an intended drilling direction and a compensating force on the drill tubular that prevents or reduces an azimuthal deviation from the intended drilling direction due to drill bit walking;

a controller configured to: receive the intended drilling direction and to provide control inputs to the steering device to automatically maintain drilling in the intended direction; and communicate a control signal to the steering device, the control signal comprising information for directing actuation of the steering device for steering the drill bit in the intended direction; and a measurement device configured to measure in a rock sample a walking angle or walking displacement resulting from a known force applied to the drill tubular in the intended drilling direction to provide measured test data;

wherein the controller is further configured to receive drill bit walking data based on the measured test data for the type of drill bit being used, the measured test data derived from at least one of an angle displacement, a direction displacement, an inclination force, a walking angle, a walking force, a walking displacement, a total force, a total displacement, an azimuthal force: and direct the steering device to provide the first force on the drill tubular in the intended drilling direction and the compensating force on the drill tubular that prevents or reduces an azimuthal deviation from the intended drilling direction due to drill bit walking.

2. The system according to claim 1, wherein the drill bit has fixed cutters and the direction of deviation is to the left with clockwise rotation in a frame of reference above the drill bit.

3. The system according to claim 1, wherein the drill bit has cutters configured to rotate and the direction of deviation is to the right with clockwise rotation in a frame of reference above the drill bit.

4. The system according to claim 1, wherein the steering device comprises a plurality of elements configured to extend and contact a borehole wall to impart a selected magnitude and direction of force on the drill tubular.

5. The system according to claim 1, wherein a direction of the compensating force is opposite to the direction that the drill bit walks.

6. The system according to claim 1, wherein the drill tubular comprises a bottomhole assembly and the controller is disposed in the bottomhole assembly.

7. The system according to claim 1, wherein the controller contains the drill bit walking data for a plurality of types of drill bits.

8. The system according to claim 1, wherein the controller comprises a lookup table configured to provide the compensating force using at least one of a type of the drill bit used and the first force applied to the drill tubular to maintain drilling in the intended drilling direction as input.

9. The system according to claim 1, wherein the measured test data for the type of drill bit being used is obtained prior to drilling the borehole.

10. The apparatus system according to claim 1, further comprising an actuator configured to apply the known force to the drill tubular in the intended drilling direction.

11. The system according to claim 10, further comprising a test stand on which the measurement device and the actuator are disposed, the test stand being configured to drill into the rock sample using the drill tubular and drill bit.

12. A method for drilling a borehole into an earth formation, the method comprising:

drilling into the formation with a drill bit being rotated by a drill tubular;

receiving an intended drilling direction using a controller and providing inclination control inputs to a steering device coupled to the drill tubular to automatically maintain drilling in the intended drilling direction;

receiving drill bit walking data based on measured test data for the type of drill bit being used using the controller, the measured test data measured in a rock sample by measuring a walking angle or walking displacement resulting from a known force applied to the drill tubular in the intended drilling direction, the measured test data derived from at least one of an angle displacement, a direction displacement, an inclination force, a walking angle, a walking force, a walking displacement, a total force, a total displacement, an azimuthal force;

communicating a control signal from the controller to the steering device coupled to the drill tubular, the control signal comprising information for directing actuation of the steering device for imparting a first force on the drill tubular for steering the drill bit in the intended drilling direction and a compensating force that prevents or reduces an azimuthal deviation from the intended drilling direction due to drill bit walking, the compensating force being a function of the force on the drill tubular in the intended drilling direction.

13. The method according to claim 12, further comprising looking up in a lookup table the compensating force to be applied by the steering device to the drill tubular, the lookup table correlating the compensating force to at least one of a type of the drill bit used and the first force applied to the drill tubular to maintain drilling in the intended drilling direction.

14. The method according to claim 12, further comprising:

imparting the compensating force on the drill tubular having a direction opposite of a walking force and a magnitude that is a percentage value multiplied by the first force in the intended drilling direction.

15. The method according to claim 12, further comprising obtaining the measured test data for the type of drill bit being used prior to drilling the borehole.

16. The method according to claim 12, further comprising applying the known force to the drill tubular in the intended drilling direction using an actuator.

17. The method according to claim 16, further comprising using a test stand on which the measurement device and actuator are disposed, the test stand being configured to drill into the rock sample using the drill tubular and the drill bit.

* * * * *